US010364539B1

(12) United States Patent
Williams

(10) Patent No.: US 10,364,539 B1
(45) Date of Patent: Jul. 30, 2019

(54) PET EXCREMENT COLLECTION APPARATUS

(71) Applicant: Asher Williams, West Orange, NJ (US)

(72) Inventor: Asher Williams, West Orange, NJ (US)

( * ) Notice: Subject to any disclaimer, the term of this patent is extended or adjusted under 35 U.S.C. 154(b) by 0 days.

(21) Appl. No.: 16/108,253

(22) Filed: Aug. 22, 2018

(51) Int. Cl.
*E01H 1/12* (2006.01)

(52) U.S. Cl.
CPC ..... *E01H 1/1206* (2013.01); *E01H 2001/128* (2013.01); *E01H 2001/1246* (2013.01); *E01H 2001/1293* (2013.01)

(58) Field of Classification Search
CPC ..... E01H 1/1206; E01H 2001/1246; E01H 2001/1233; E01H 2001/128; E01H 2001/1286; E01H 2001/1293; A01K 23/005
USPC ..... 294/1.5
See application file for complete search history.

(56) References Cited

U.S. PATENT DOCUMENTS

D253,915 S 1/1980 Hennessy
4,236,741 A 12/1980 Emme
4,335,678 A * 6/1982 Garza ..... A01K 23/005 294/1.5
D369,444 S 4/1996 Ubdegrove
5,628,537 A 5/1997 Kiemer
5,820,179 A 10/1998 Tsou
7,198,310 B1 4/2007 Lau
7,431,361 B2 10/2008 Pilas
7,686,361 B1 * 3/2010 Flinn ..... E01H 1/1206 294/1.4
7,735,886 B2 6/2010 Tsukamoto
8,550,512 B2 * 10/2013 Jones, Jr. ..... A01K 23/005 294/1.5
2004/0174026 A1 9/2004 Sampaio
2008/0012366 A1 * 1/2008 Tsukamoto ..... A01K 23/005 294/1.5
2009/0152884 A1 * 6/2009 Ruscil ..... B65G 7/12 294/1.5
2015/0021943 A1 1/2015 Montgomery

* cited by examiner

*Primary Examiner* — Stephen A Vu

(57) ABSTRACT

A pet excrement collection apparatus for handsfree waste pickup includes a handle and a hollow extension pole coupled to the handle. A trigger is coupled to the handle and is coupled to a jaw rod extending through the extension pole and out a jaw rod aperture between a forked distal end of the extension pole. A pair of arms is coupled to the distal end, each having a toothed rotator wheel engaged with a plurality of jaw rod teeth of the jaw rod. A waste bag is coupled to a bag frame and a pair of bag rods. A pair of bag rod receptacle mechanisms is coupled to each of the pair of arms and selectively receives the pair of bag rods. A release mechanism engages a release end of the pair of bag rods and alternatively releases the pair of bag rods when activated by a bag eject lever.

6 Claims, 9 Drawing Sheets

PET EXCREMENT COLLECTION APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to waste scoopers and more particularly pertains to a new waste scooper for handsfree waste pickup.

BRIEF SUMMARY OF THE INVENTION

An embodiment of the disclosure meets the needs presented above by generally comprising a handle having a cavity, a trigger aperture extending through to the cavity, and an extension aperture extending through to the cavity. A hollow extension pole is coupled to the handle and has an open proximal end, an open distal end, a dorsal side, and a ventral side. The distal end is forked and has a left tine, a right tine, and a jaw rod aperture between the left tine and the right tine. A trigger is coupled to the handle and has an exposed portion and an internal portion. The internal portion is pivotably coupled within the cavity of the handle and the exposed portion extends through the trigger aperture. The trigger has a rest position and an alternate squeezed position. A jaw rod has a trigger end coupled to the trigger and the trigger spring. The jaw rod extends through the hollow extension pole and out the jaw rod aperture of the distal end with a toothed end extending beyond the jaw rod aperture and between the right tine and the left tine. The toothed end has a plurality of jaw rod teeth. The jaw rod has a retracted position when the trigger is in the rest position and an alternate extended position when the trigger is in the squeezed position. A pair of arms is coupled to the distal end of the extension pole and comprises a right arm pivotably coupled to the right tine and a left arm pivotably coupled to the left tine. Each of the right arm and the left arm have a pivot end and a bag end, each of the pivot ends have a toothed rotator wheel, and each of the toothed rotator wheels have a plurality of rotator teeth engaged with the plurality of jaw rod teeth of the jaw rod. Translational movement of the jaw rod from the retracted position to the extended position thus rotates the pair of arms to and from a closed position to an alternate open position. A bag frame has a rear side, a front side, a pair of bag cable apertures, and a pair of bag rod apertures with each of the pair of bag cable apertures and each of the pair of bag rod apertures extending from the front side through to the rear side. A pair of bag rods is coupled to the bag frame, each having a toothed portion and a smooth portion. The pair of bag rods is coupled within the pair of bag rod apertures such that the toothed portion extends from the rear side of the bag frame and the smooth portion extends from the front side of bag frame. The toothed portion has a plurality of bag rod teeth and a release end and the smooth portion has a terminal end. A waste bag is coupled to the bag frame and has a frame side, a pair of lateral sides, and a terminal side. The frame side is continuously coupled to the bag frame and the terminal side has a pair of terminal apertures slidingly coupled to the pair of bag rods. A pair of bag rod receptacle mechanisms is coupled to each of the pair of arms and selectively receives the pair of bag rods. Each of the pair of bag receptacle mechanisms has a spring-loaded gear wheel and a release mechanism. The gear wheel engages the plurality of bag rod teeth and the pair of bag rods winds a recoil spring of each of the gear wheels as it is inserted. The release mechanism engages the release end of the pair of bag rods and alternatively releases the pair of bag rods when activated, allowing the gear wheels to eject the pair of bag rods as the recoil spring unwinds. An ejection lever cable is coupled to each of the pair of bag rod receptacle mechanisms and has a split end and a lever end, the split end being coupled to the release mechanism of each of the pair of bag receptacle mechanisms. A bag eject lever coupled within the hollow extension pole has a cable end coupled to the lever end of the ejection lever cable and a button end extending through a lever channel of the hollow extension pole. The bag eject lever has a lock position and an alternate release position with the release position pulling on the ejection lever cable to activate the release mechanism of each of the pair of bag receptacle mechanisms. The bag eject lever has a lever spring coupled to the hollow extension pole such that the lever spring automatically returns the bag eject lever from the release position to the lock position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
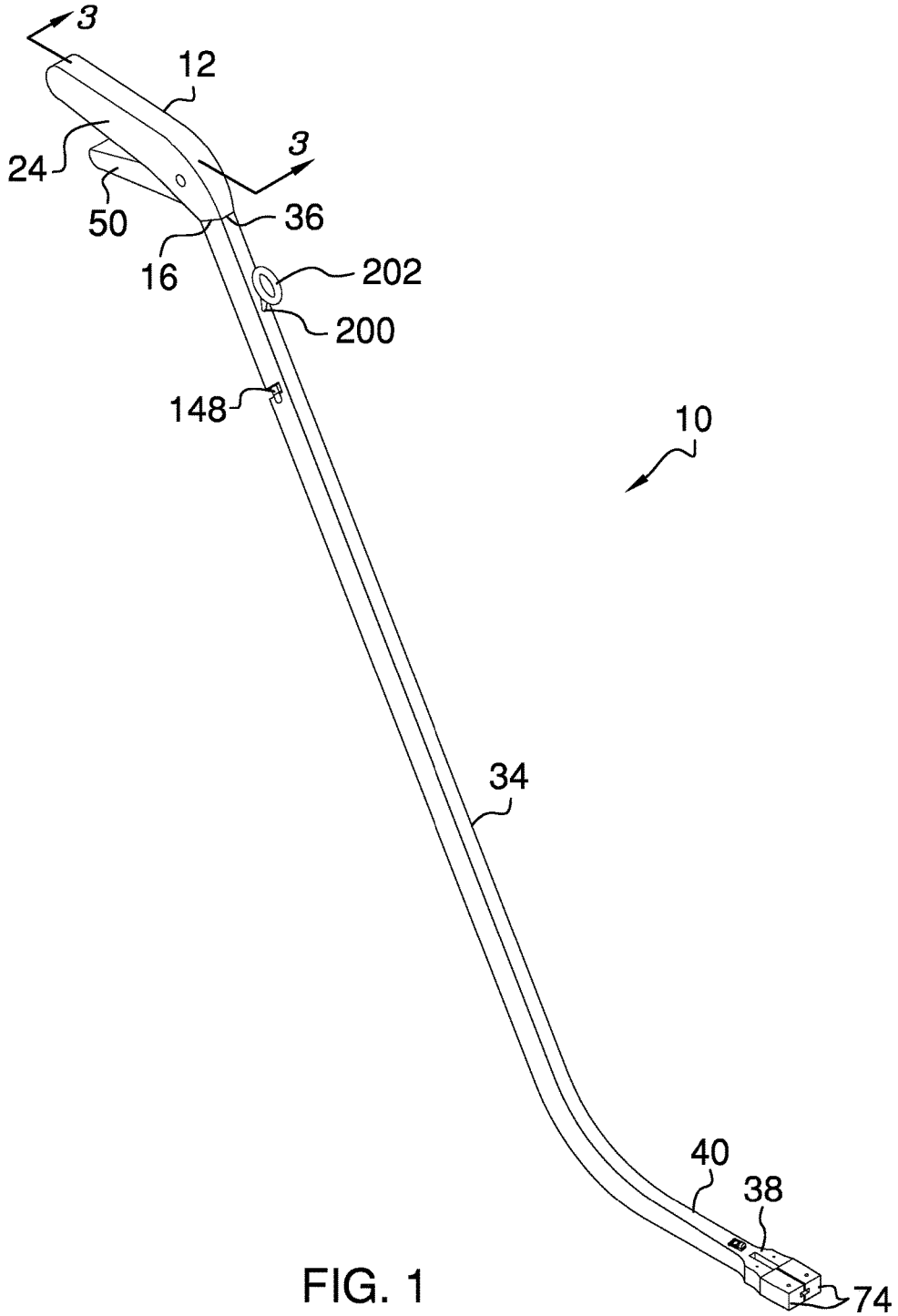
FIG. 1 is an isometric view of a pet excrement collection apparatus according to an embodiment of the disclosure.
Figure 2:
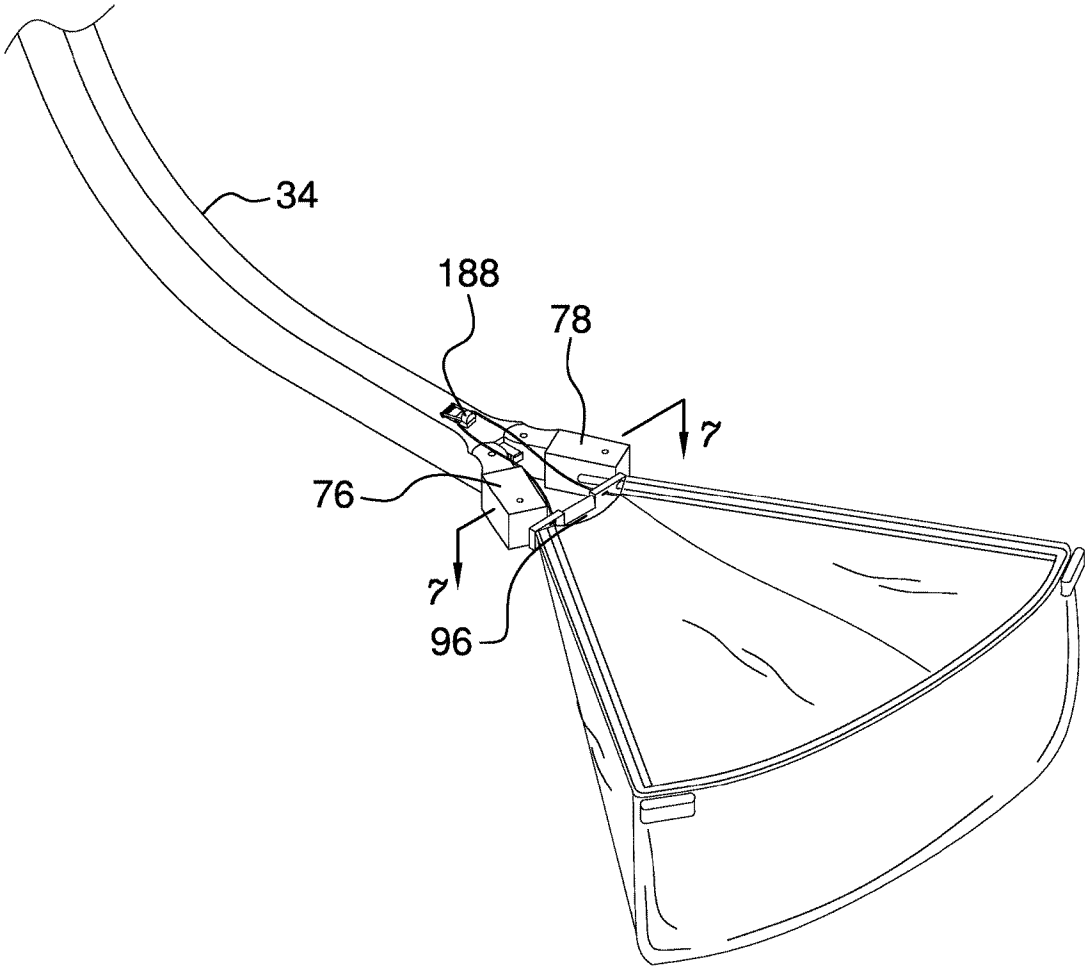
FIG. 2 is an isometric detail view of an embodiment of the disclosure.
Figure 3:
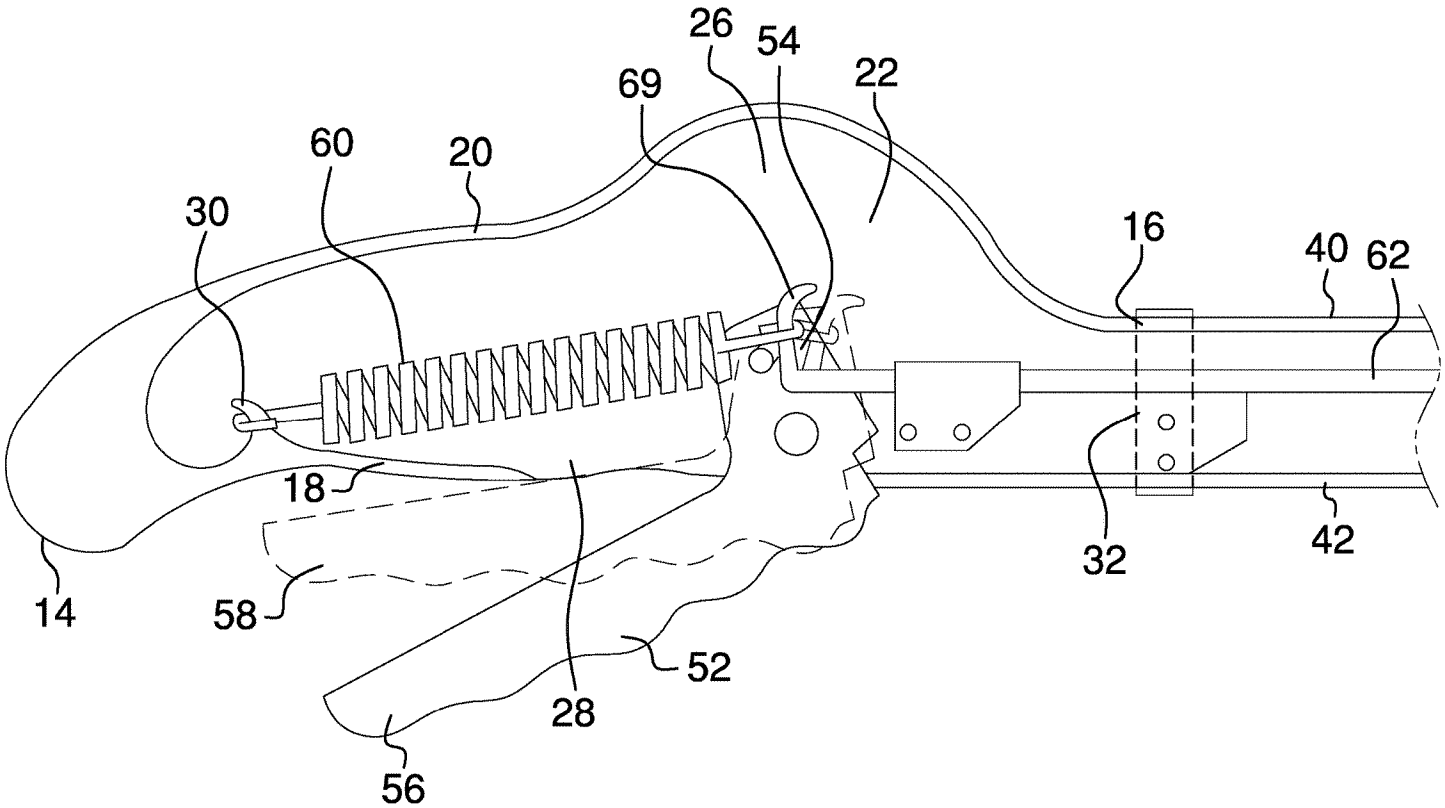
FIG. 3 is a cross-sectional view of an embodiment of the disclosure along line 3-3 of FIG. 1.
Figure 4:
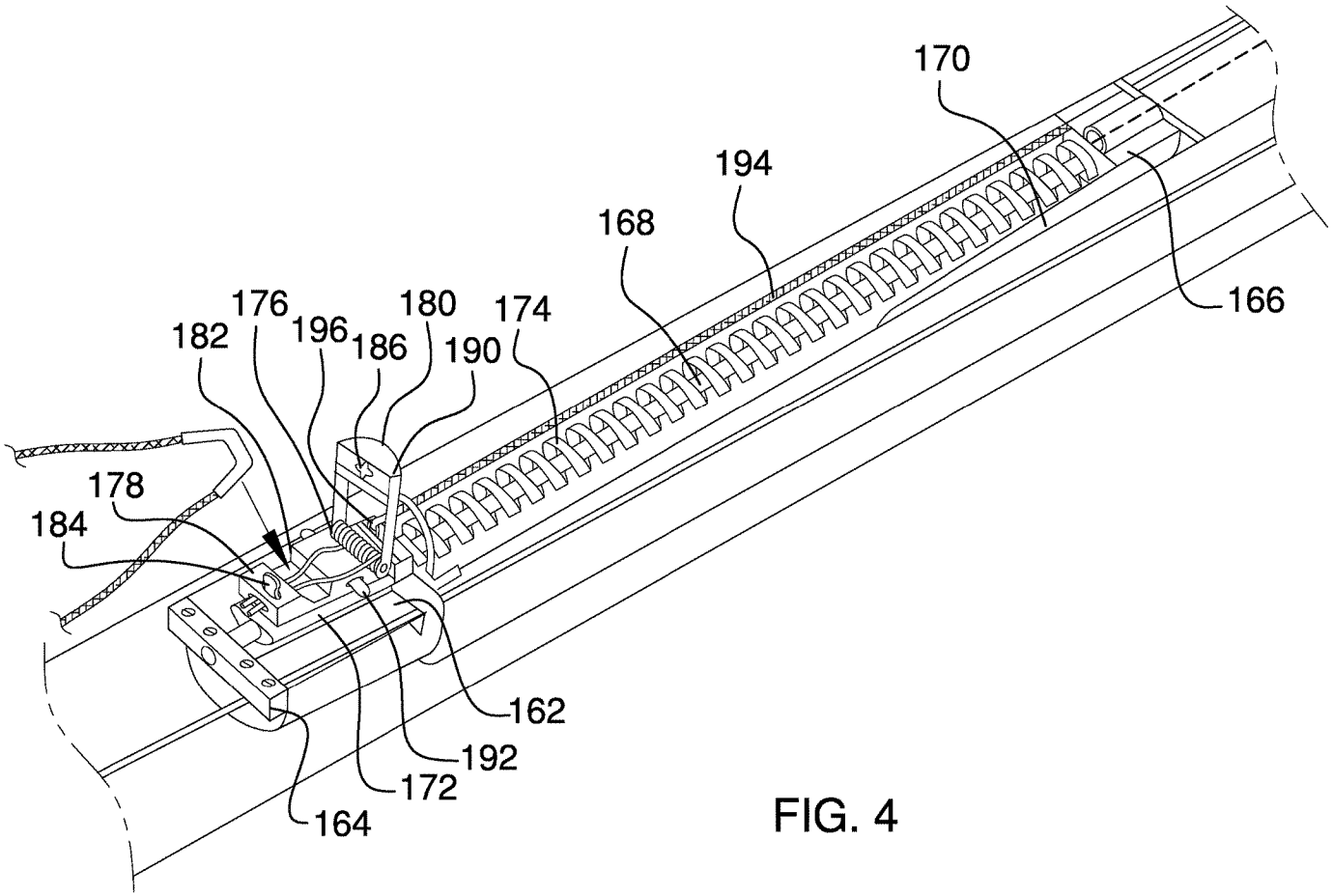
FIG. 4 is an isometric detail view of an embodiment of the disclosure.
Figure 5:
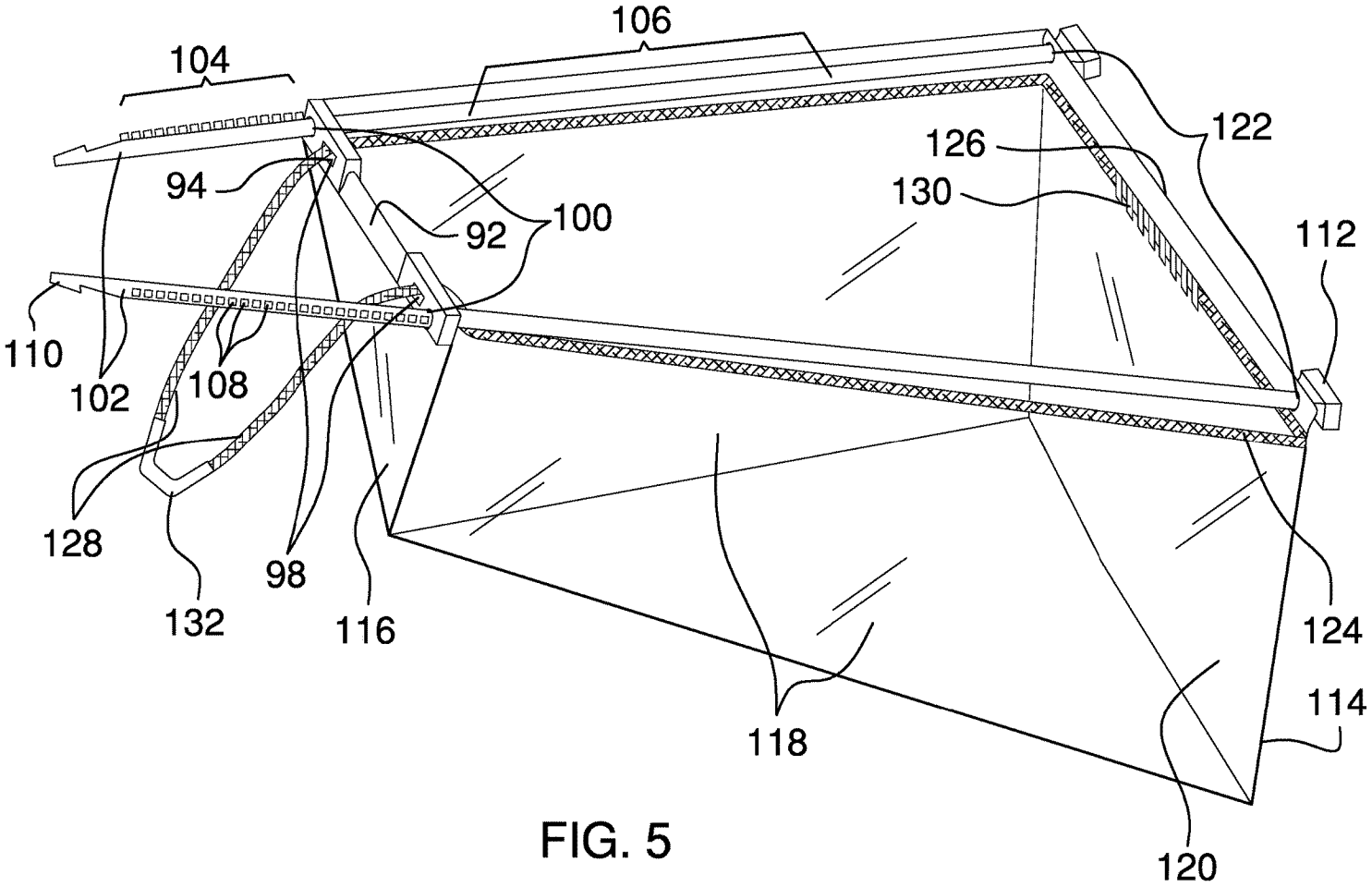
FIG. 5 is an isometric detail view of an embodiment of the disclosure.
Figure 6:
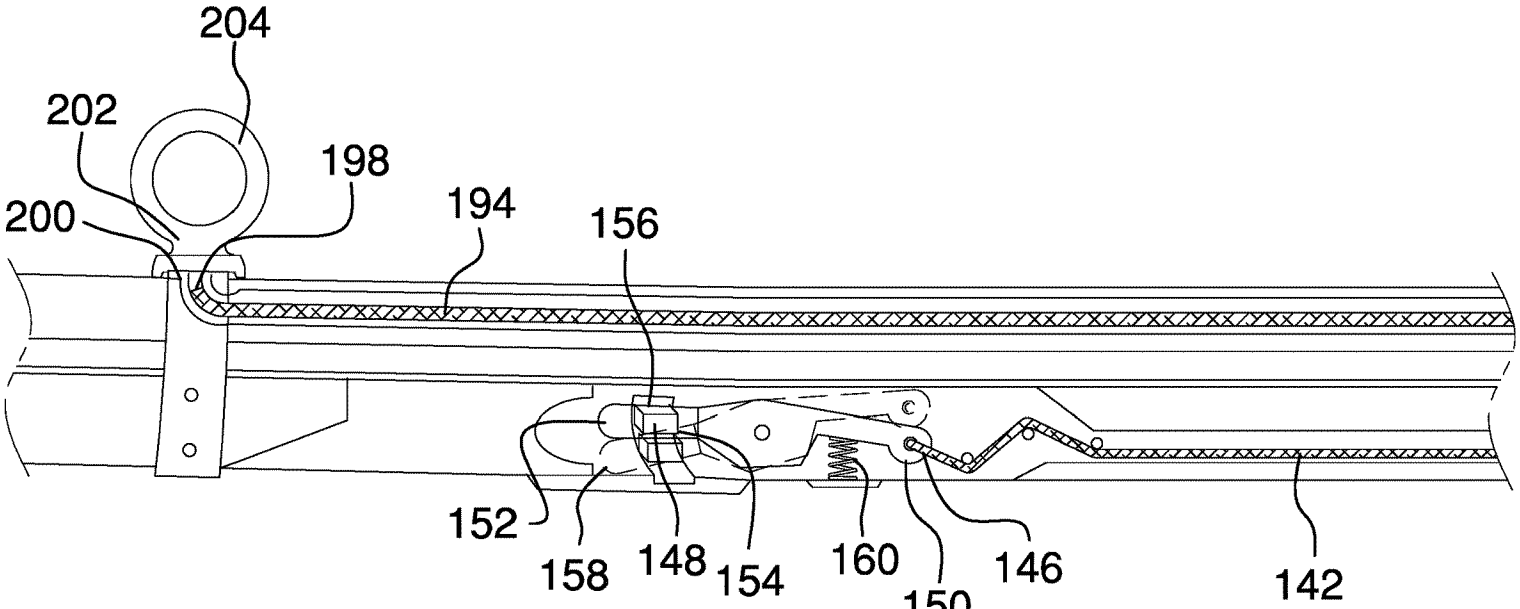
FIG. 6 is a side elevation detail view of an embodiment of the disclosure.
Figure 7:
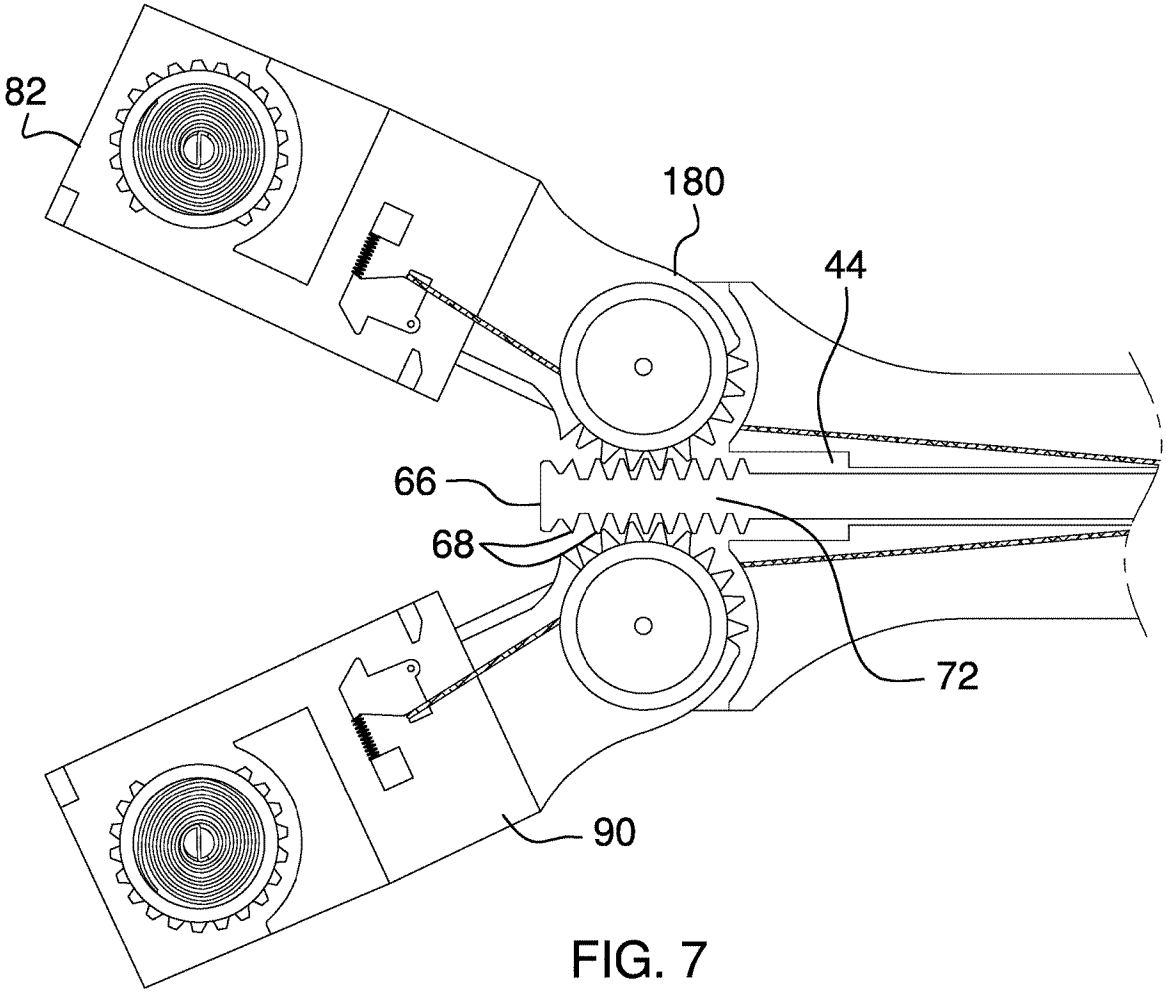
FIG. 7 is a cross-sectional view of an embodiment of the disclosure along line 7-7 of FIG. 2.
Figure 8:
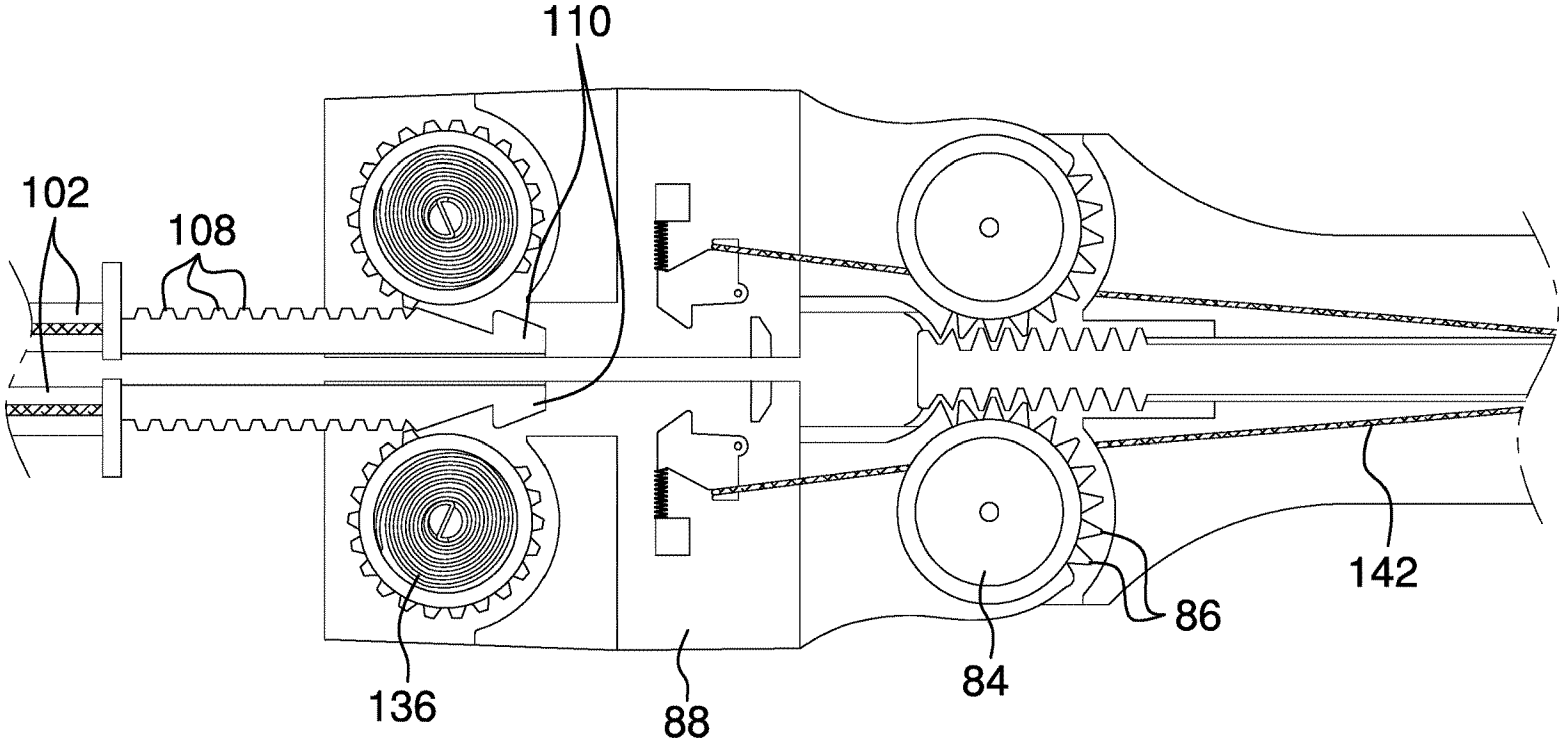
FIG. 8 is a cross-sectional view of an embodiment of the disclosure.
Figure 9:
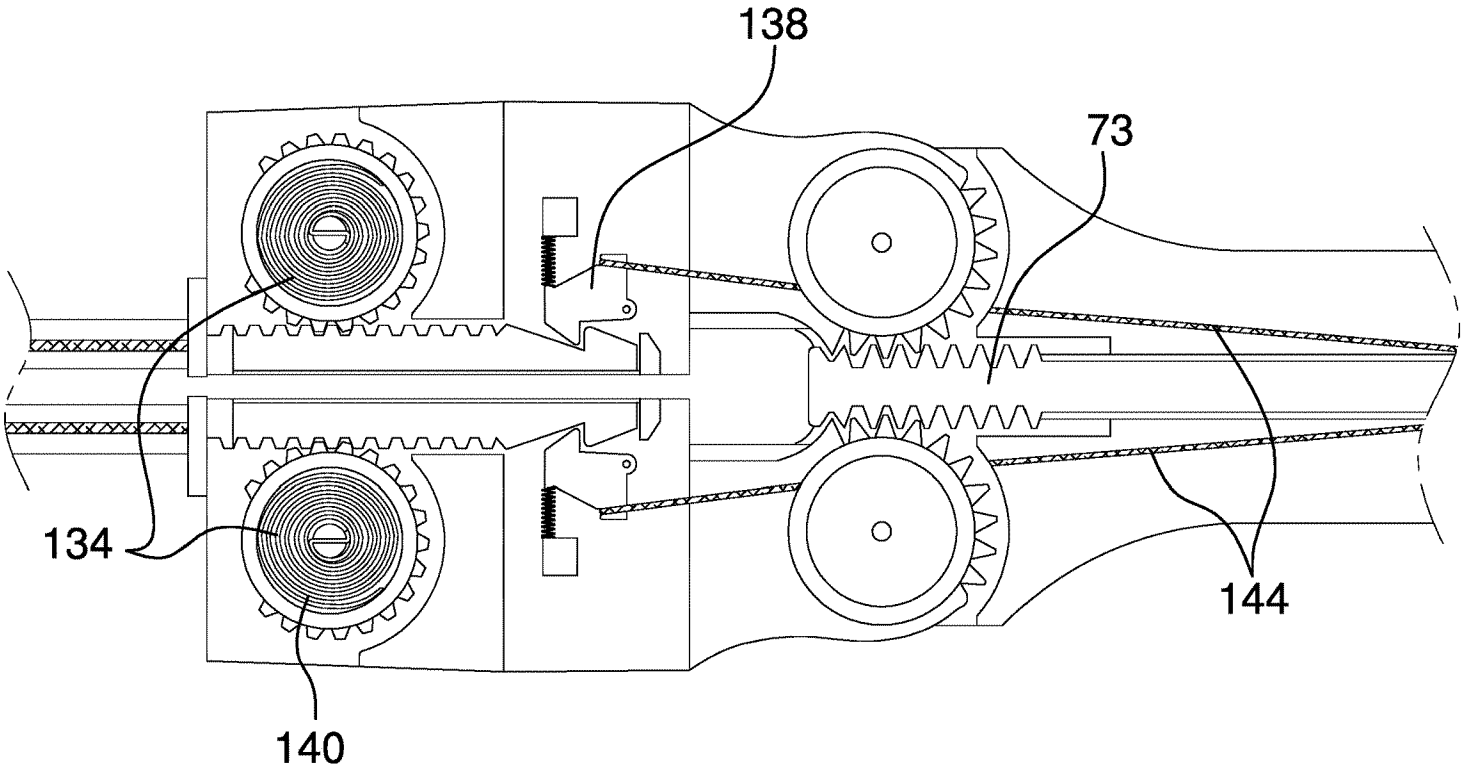
FIG. 9 is a cross-sectional view of an embodiment of the disclosure.

With reference now to the drawings, and in particular to FIGS. 1 through 9 thereof, a new waste scooper embodying the principles and concepts of an embodiment of the disclosure and generally designated by the reference numeral 10 will be described.

As best illustrated in FIGS. 1 through 9, the pet excrement collection apparatus 10 generally comprises a handle 12 having a butt end 14 separated from a front end 16, a bottom side 18 separated from a top side 20, and a left side 22 separated from a right side 24. The handle 12 has a cavity 26 disposed between the butt end 14, the front end 16, the bottom side 18, the top side 20, the left side 22, and the right side 24. The bottom side 18 has a trigger aperture 28 extending through to the cavity 26 and a spring catch 30 extending into the cavity 26 proximal the butt end 14, and the front end 16 has an extension aperture 32 extending through to the cavity 26.

A hollow extension pole 34 is coupled to the handle 12 and has an open proximal end 36, an open distal end 38, a dorsal side 40, and a ventral side 42. The proximal end 36 is coupled to the front end 16 of the handle and the distal end 38 is forked and has a left tine 44 and a right tine 46 with a jaw rod aperture 48 between the left tine and the right tine. A trigger 50 having an exposed portion 52 and an internal portion 54 is coupled to the handle 12 with the internal portion 54 being pivotably coupled within the cavity 26 of the handle and the exposed portion 52 extending through the trigger aperture 28. The trigger 50 has a rest position 56 and an alternate squeezed position 58. A trigger spring 60 is coupled to the trigger 50 and to the handle 12 and extends between the internal portion 54 of the trigger and the spring catch 30 of the handle. The trigger spring 60 returns the trigger from the squeezed position 58 to the rest position 56. A jaw rod 62 has a trigger end 64 coupled to the trigger 50 and the trigger spring 60. The jaw rod 62 extends through the hollow extension pole 34 and out the jaw rod aperture 48 of the distal end with a toothed end 66 extending beyond the jaw rod aperture 48 and between the right tine 46 and the left tine 44. The toothed end 66 has a plurality of jaw rod teeth 68. The jaw rod 62 has a retracted position 70 when the trigger 50 is in the rest position 56 and an alternate extended position 72 when the trigger is in the squeezed position 58. A pair of arms 74 is coupled to the distal end 38 of the extension pole and comprises a right arm 76 pivotably coupled to the right tine 46 and a left arm 78 pivotably coupled to the left tine 44. Each of the right arm 76 and the left arm 78 have a pivot end 80 and a bag end 82, each of the pivot ends 80 has a toothed rotator wheel 84, and each of the toothed rotator wheels has a plurality of rotator teeth 86 engaged with the plurality of jaw rod teeth 68 of the jaw rod. Translational movement of the jaw rod 62 from the retracted position 70 to the extended position 72 thus rotates the pair of arms 74 to and from a closed position 88 and an alternate open position 90.

A bag frame 92 has a rear side 94, a front side 96, a pair of bag cable apertures 98, and a pair of bag rod apertures 100 with each of the pair of bag cable apertures and each of the pair of bag rod apertures extending from the front side 96 through to the rear side 94. A pair of bag rods 102 is coupled to the bag frame 92, each having a toothed portion 104 and a smooth portion 106. The pair of bag rods 102 is coupled within the pair of bag rod apertures 100 such that the toothed portion 104 extends from the rear side 94 of the bag frame and the smooth portion 106 extends from the front side 96 of bag frame. The toothed portion 104 has a plurality of bag rod teeth 108 and a release end 110 and the smooth portion 106 has a terminal end 112. A waste bag 114 is coupled to the bag frame 92 and has a frame side 116, a pair of lateral sides 118, and a terminal side 120. The frame side 116 is continuously coupled to the bag frame 92 and the terminal side 120 has a pair of terminal apertures 122 slidingly coupled to the pair of bag rods 102. A bag cable 124 may be coupled to the waste bag 114 and is continuously disposed within an upper perimeter 126 of the waste bag along the terminal side 120 and the pair of lateral sides 118. The bag cable 124 has a pair of free ends 128 extending through the pair of bag cable apertures 98. The bag cable 124 may have a plurality of closing teeth 130 on the terminal side 120 of the waste bag to secure the waste bag 114 closed when the bag cable 124 is drawn by the pair of free ends 128. A cable hook 132 is coupled to each of the pair of free ends 128 of the bag cable.

A pair of bag rod receptacle mechanisms 134 is coupled to each of the pair of arms 74 and selectively receives the pair of bag rods 102. Each of the pair of bag receptacle mechanisms 134 has a spring-loaded gear wheel 136 and a release mechanism 138. The gear wheel 136 engages the plurality of bag rod teeth 108 and the pair of bag rods 102 winds a recoil spring 140 of each of the gear wheels 136 as it is inserted. The release mechanism 138 engages the release end 110 of the pair of bag rods and alternatively releases the pair of bag rods 102 when activated, allowing the gear wheels 136 to eject the pair of bag rods 102 as the recoil spring 140 unwinds. An ejection lever cable 142 is coupled to each of the pair of bag rod receptacle mechanisms 134 and has a split end 144 and a lever end 146 with the split end 144 coupled to the release mechanism 138 of each of the pair of bag receptacle mechanisms. A bag eject lever 148 coupled within the hollow extension pole 34 has a cable end 150 coupled to the lever end 146 of the ejection lever cable and a button end 152 extending through a lever channel 154 of the hollow extension pole. The bag eject lever 148 has a lock position 156 and an alternate release position 158 with the release position pulling on the ejection lever cable 142 to activate the release mechanism 138 of each of the pair of bag receptacle mechanisms. The bag eject lever 148 has a lever spring 160 coupled to the hollow extension pole 34 such that the lever spring automatically returns the bag eject lever 148 from the release position 158 to the lock position 156.

A clamp track 162 may be coupled within the hollow extension pole 34 proximal the distal end 38. The clamp track 162 has a lower stopper 164, an upper stopper 166, a rail 168 extending from the lower stopper to the upper stopper, and a tapered shoulder 170 proximal the upper stopper. A clamp slide 172 is slidably coupled to the rail 168 such that it travels from the lower stopper 164 to the upper stopper 166. A slide spring 174 is coupled to the clamp slide 172 and extends from the clamp slide to the upper stopper 166. The slide spring 174 returns the clamp slide 172 to the lower stopper 164. A cable clamp 176 is coupled to the clamp slide 172 and has a lower clamp 178 and an upper clamp 180. The upper clamp 180 is pivotably coupled to the lower clamp 178 which has a hook channel 182 and a latch 184. The hook channel 182 receives the cable hook 132 and the latch 184 selectively engages a latch receptacle 186 of the upper clamp. The cable clamp 176 has a clamped position 188 and an alternate free position 190 such that the clamped position secures the cable hook 132 within the hook channel 182 and the free position releases the cable hook 132. A pair of latch pins 192 is coupled to the latch 184 and releases the latch when depressed to open the upper clamp 180 from the clamped position 188 to the alternate free position 190. The pair of latch pins 192 is depressed by the tapered shoulder 170 when the clamp slide 172 approaches the upper stopper 166. A closing cable 194 has a slide end 196 coupled to the clamp slide 172 and a handle end 198 extending through the hollow extension pole 34 and out a closing cable aperture 200 in the dorsal side 40 of the hollow extension pole. A closing handle 202 is coupled to the handle end 198 of the closing cable. The closing handle 202 may be a ring 204. The closing handle 202 moves the clamp slide 172 along the rail 168 when pulled with the cable clamp 176 drawing the bag cable 124 and cinching the waste bag 114.

In use, a user places the waste bag 114 over pet excrement and squeezes the trigger 50 to the squeezed position 58 to move the pair of arms 74 from the closed position 88 to the alternate open position 90, thus spreading the pair of bag rods 102 and opening the waste bag 114. The user then touches the pair of bag rods 102 to the ground and releases the trigger 50 to the rest position 56 to return the pair of arms to the closed position 88. The user then pulls on the closing handle 202 to cinch the waste bag 114. As the clamp slide 172 nears the upper stopper, the pair of latch pins 192 is depressed by the tapered shoulder 170 to move the cable clamp 176 from the clamped position 188 to the free position 190, releasing the cable hook 132. The user then pushes the bag eject lever 148 from the lock position 156 to the release position 158 to release the pair of bag rods 102 from the pair of bag rod receptacle mechanisms 134 and to dispose of the used waste bag 114.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A pet excrement collection apparatus comprising:

a handle having a cavity, a trigger aperture extending through said handle to the cavity, and an extension aperture extending through said handle to the cavity;

a hollow extension pole coupled to the handle, the extension pole having an open proximal end, an open distal end, a dorsal side, and a ventral side, the distal end being forked and having a left tine and a right tine, the distal end having a jaw rod aperture between the left tine and the right tine;

a trigger coupled to the handle, the trigger having an exposed portion and an internal portion, the internal portion being pivotably coupled within the cavity of the handle and the exposed portion extending through the trigger aperture, the trigger having a rest position and an alternate squeezed position;

a jaw rod coupled to the trigger, the jaw rod having a trigger end coupled to the trigger and the trigger spring, the jaw rod extending through the hollow extension pole and out the jaw rod aperture of the distal end, the jaw rod having a toothed end extending beyond the jaw rod aperture and between the right tine and the left tine, the toothed end having a plurality of jaw rod teeth, the jaw rod having a retracted position when the trigger is in the rest position and an alternate extended position when the trigger is in the squeezed position;

a pair of arms coupled to the distal end of the extension pole, the pair of arms comprising a right arm pivotably coupled to the right tine and a left arm pivotably coupled to the left tine, each of the right arm and the left arm having a pivot end and a bag end, each of the pivot ends having a toothed rotator wheel, each of the toothed rotator wheels having a plurality of rotator teeth engaged with the plurality of jaw rod teeth of the jaw rod, translational movement of the jaw rod from the retracted position to the extended position thus rotating the pair of arms from a closed position to an alternate open position;

a bag frame having a rear side, a front side, a pair of bag cable apertures, and a pair of bag rod apertures, each of the pair of bag cable apertures and each of the pair of bag rod apertures extending from the front side through to the rear side;

a pair of bag rods coupled to the bag frame, each of the pair of bag rods having a toothed portion and a smooth portion, the pair of bag rods being coupled within the pair of bag rod apertures having the toothed portion extending from the rear side of the bag frame and the smooth portion extending from the front side of bag frame, the toothed portion having a plurality of bag rod teeth and a release end, the smooth portion having a terminal end;

a waste bag coupled to the bag frame, the waste bag having a frame side, a pair of lateral sides, and a terminal side, the frame side being continuously coupled to the bag frame and the terminal side having a pair of terminal apertures, the pair of terminal apertures being slidingly coupled to the pair of bag rods;

a pair of bag rod receptacle mechanisms coupled to each of the pair of arms, the pair of bag rod receptacle mechanisms selectively receiving the pair of bag rods, each of the pair of bag receptacle mechanisms having a spring-loaded gear wheel and a release mechanism, the gear wheel engaging the plurality of bag rod teeth, the pair of bag rods winding a recoil spring of each of the gear wheels as it is inserted, the release mechanism engaging the release end of the pair of bag rods and alternatively releasing the pair of bag rods when activated, the gear wheels ejecting the pair of bag rods as the recoil spring unwinds;

an ejection lever cable coupled to each of the pair of bag rod receptacle mechanisms, the ejection lever having a split end and a lever end, the split end being coupled to the release mechanism of each of the pair of bag receptacle mechanisms; and a bag eject lever coupled within the hollow extension pole, the bag eject lever having a cable end coupled to the lever end of the ejection lever cable and a button end extending through a lever channel of the hollow extension pole, the bag eject lever having a lock position and an alternate release position, the release position pulling on the ejection lever cable to activate the release mechanism of each of the pair of bag receptacle mechanisms, the bag eject lever having a lever spring coupled to the hollow extension pole, the lever spring automatically returning the bag eject lever from the release position to the lock position.

2. The pet excrement collection apparatus of claim 1 further comprising the handle having a butt end separated from a front end, a bottom side separated from a top side, and a left side separated from a right side, the cavity being disposed between the butt end, the front end, the bottom side, the top side, the left side, and the right side, the trigger aperture extending through the bottom side, a spring catch extending into the cavity proximal the butt end, and the extension aperture extending through the front end to the cavity.

3. The pet excrement collection apparatus of claim 1 further comprising a trigger spring coupled to the trigger and to the handle, the trigger spring extending between the internal portion of the trigger and the spring catch of the handle, the trigger spring returning the trigger from the squeezed position to the rest position.

4. The pet excrement collection apparatus of claim 1 further comprising:

a bag cable coupled to the waste bag, the bag cable being continuously disposed within an upper perimeter of the waste bag along the terminal side and the pair of lateral sides, the bag cable having a pair of free ends extending through the pair of bag cable apertures;

a cable hook coupled to the cable bag, the cable hook being coupled to each of the pair of free ends;

a clamp track coupled within the hollow extension pole proximal the distal end, the clamp track having a lower stopper, an upper stopper, a rail extending from the lower stopper to the upper stopper, and a tapered shoulder proximal the upper stopper;

a clamp slide coupled to the rail, the clamp slide being slidably coupled such that it travels from the lower stopper to the upper stopper;

a slide spring coupled to the clamp slide, the slide spring extending from the clamp slide to the upper stopper;

a cable clamp coupled to the clamp slide, the cable clamp having a lower clamp and an upper clamp, the upper clamp being pivotably coupled to the lower clamp, the lower clamp having a hook channel and a latch, the hook channel receiving the cable hook and the latch selectively engaging a latch receptacle of the upper clamp, the cable clamp having a clamped position and an alternate free position, the clamped position securing the cable hook within the hook channel and the free position releasing the cable hook;

a pair of latch pins coupled to the lower clamp, the pair of latch pins being coupled to the latch, the pair of latch pins releasing the latch when depressed to open the upper clamp from the clamped position to the alternate free position, the pair of latch pins being depressed by the tapered shoulder when the clamp slide approaches the upper stopper;

a closing cable coupled to the clamp slide, the closing cable having a slide end coupled to the clamp slide and a handle end extending through the hollow extension pole and out a closing cable aperture in the dorsal side of the hollow extension pole; and a closing handle coupled to the handle end of the closing cable, the closing handle being a ring, the closing handle moving the clamp slide along the rail when pulled, the cable clamp drawing the bag cable and cinching the waste bag.

5. The pet excrement collection apparatus of claim 4 further comprising the bag cable having a plurality of closing teeth on the terminal side of the waste bag, the plurality of closing teeth securing the waste bag closure when the bag cable is drawn by the pair of free ends.

6. A pet excrement collection apparatus comprising:

a handle having a butt end separated from a front end, a bottom side separated from a top side, and a left side separated from a right side, the handle having a cavity disposed between the butt end, the front end, the bottom side, the top side, the left side, and the right side, the bottom side having a trigger aperture extending through to the cavity and a spring catch extending into the cavity proximal the butt end, the front end having an extension aperture extending through to the cavity;

a hollow extension pole coupled to the handle, the extension pole having an open proximal end, an open distal end, a dorsal side, and a ventral side, the proximal end being coupled to the front end of the handle, the distal end being forked and having a left tine and a right tine, the distal end having a jaw rod aperture between the left tine and the right tine;

a trigger coupled to the handle, the trigger having an exposed portion and an internal portion, the internal portion being pivotably coupled within the cavity of the handle and the exposed portion extending through the trigger aperture, the trigger having a rest position and an alternate squeezed position;

a trigger spring coupled to the trigger and to the handle, the trigger spring extending between the internal portion of the trigger and the spring catch of the handle, the trigger spring returning the trigger from the squeezed position to the rest position;

a jaw rod coupled to the trigger, the jaw rod having a trigger end coupled to the trigger and the trigger spring, the jaw rod extending through the hollow extension pole and out the jaw rod aperture of the distal end, the jaw rod having a toothed end extending beyond the jaw rod aperture and between the right tine and the left tine, the toothed end having a plurality of jaw rod teeth, the jaw rod having a retracted position when the trigger is in the rest position and an alternate extended position when the trigger is in the squeezed position;

a pair of arms coupled to the distal end of the extension pole, the pair of arms comprising a right arm pivotably coupled to the right tine and a left arm pivotably coupled to the left tine, each of the right arm and the left arm having a pivot end and a bag end, each of the pivot ends having a toothed rotator wheel, each of the toothed rotator wheels having a plurality of rotator teeth engaged with the plurality of jaw rod teeth of the jaw rod, translational movement of the jaw rod from the retracted position to the extended position thus rotating the pair of arms from a closed position to an alternate open position;

a bag frame having a rear side, a front side, a pair of bag cable apertures, and a pair of bag rod apertures, each of the pair of bag cable apertures and each of the pair of bag rod apertures extending from the front side through to the rear side;

a pair of bag rods coupled to the bag frame, each of the pair of bag rods having a toothed portion and a smooth portion, the pair of bag rods being coupled within the pair of bag rod apertures having the toothed portion extending from the rear side of the bag frame and the smooth portion extending from the front side of bag frame, the toothed portion having a plurality of bag rod teeth and a release end, the smooth portion having a terminal end;

a waste bag coupled to the bag frame, the waste bag having a frame side, a pair of lateral sides, and a terminal side, the frame side being continuously coupled to the bag frame and the terminal side having a pair of terminal apertures, the pair of terminal apertures being slidingly coupled to the pair of bag rods;

a bag cable coupled to the waste bag, the bag cable being continuously disposed within an upper perimeter of the waste bag along the terminal side and the pair of lateral sides, the bag cable having a pair of free ends extending through the pair of bag cable apertures, the bag cable having a plurality of closing teeth on the terminal side of the waste bag, the plurality of closing teeth securing the waste bag closure when the bag cable is drawn by the pair of free ends;

a cable hook coupled to the cable bag, the cable hook being coupled to each of the pair of free ends;

a pair of bag rod receptacle mechanisms coupled to each of the pair of arms, the pair of bag rod receptacle mechanisms selectively receiving the pair of bag rods, each of the pair of bag receptacle mechanisms having a spring-loaded gear wheel and a release mechanism, the gear wheel engaging the plurality of bag rod teeth, the pair of bag rods winding a recoil spring of each of the gear wheels as it is inserted, the release mechanism engaging the release end of the pair of bag rods and alternatively releasing the pair of bag rods when activated, the gear wheels ejecting the pair of bag rods as the recoil spring unwinds;

an ejection lever cable coupled to each of the pair of bag rod receptacle mechanisms, the ejection lever having a split end and a lever end, the split end being coupled to the release mechanism of each of the pair of bag receptacle mechanisms;

a bag eject lever coupled within the hollow extension pole, the bag eject lever having a cable end coupled to the lever end of the ejection lever cable and a button end extending through a lever channel of the hollow extension pole, the bag eject lever having a lock position and an alternate release position, the release position pulling on the ejection lever cable to activate the release mechanism of each of the pair of bag receptacle mechanisms, the bag eject lever having a lever spring coupled to the hollow extension pole, the lever spring automatically returning the bag eject lever from the release position to the lock position;

a clamp track coupled within the hollow extension pole proximal the distal end, the clamp track having a lower stopper, an upper stopper, a rail extending from the lower stopper to the upper stopper, and a tapered shoulder proximal the upper stopper;

a clamp slide coupled to the rail, the clamp slide being slidably coupled such that it travels from the lower stopper to the upper stopper;

a slide spring coupled to the clamp slide, the slide spring extending from the clamp slide to the upper stopper;

a cable clamp coupled to the clamp slide, the cable clamp having a lower clamp and an upper clamp, the upper clamp being pivotably coupled to the lower clamp, the lower clamp having a hook channel and a latch, the hook channel receiving the cable hook and the latch selectively engaging a latch receptacle of the upper clamp, the cable clamp having a clamped position and an alternate free position, the clamped position securing the cable hook within the hook channel and the free position releasing the cable hook;

a pair of latch pins coupled to the lower clamp, the pair of latch pins being coupled to the latch, the pair of latch pins releasing the latch when depressed to open the upper clamp from the clamped position to the alternate free position, the pair of latch pins being depressed by the tapered shoulder when the clamp slide approaches the upper stopper;

a closing cable coupled to the clamp slide, the closing cable having a slide end coupled to the clamp slide and a handle end extending through the hollow extension pole and out a closing cable aperture in the dorsal side of the hollow extension pole; and a closing handle coupled to the handle end of the closing cable, the closing handle being a ring, the closing handle moving the clamp slide along the rail when pulled, the cable clamp drawing the bag cable and cinching the waste bag.

* * * * *